US006126393A

United States Patent [19]

Arnold

[11] Patent Number: 6,126,393

[45] **Date of Patent: *Oct. 3, 2000**

[54] LOW NOISE AIR BLOWER UNIT FOR INFLATING BLANKETS

[75] Inventor: Randall C. Arnold, Wood Ridge, Minn.

[73] Assignee: Augustine Medical, Inc., Eden Prairie, Minn.

[ * ] Notice: Under 35 U.S.C. 154(b), the term of this patent shall be extended for 522 days.

[21] Appl. No.: 08/525,407

[22] Filed: Sep. 8, 1995

[51] Int. Cl.[7] ..... F01D 25/04

[52] U.S. Cl. ..... 415/119; 415/206; 607/96

[58] Field of Search ..... 415/206, 119; 607/96, 98, 107

[56] References Cited

U.S. PATENT DOCUMENTS

| | | | |
|---|---|---|---|
| 4,398,535 | 8/1983 | Guibert | 607/107 |
| 4,572,188 | 2/1986 | Augustine et al. | 128/380 |
| 4,587,959 | 5/1986 | Ruderian | 607/107 |
| 4,595,008 | 6/1986 | Guibert | 607/107 |
| 4,597,757 | 7/1986 | Ruderian | 607/107 |
| 5,085,057 | 2/1992 | Thompson et al. | 415/119 |
| 5,215,433 | 6/1993 | Weiland et al. | 415/119 |
| 5,300,101 | 4/1994 | Augustine et al. | 607/107 |
| 5,300,102 | 4/1994 | Augustine et al. | 607/107 |
| 5,324,320 | 6/1994 | Augustine et al. | 607/107 |
| 5,336,250 | 8/1994 | Augustine | 607/107 |
| 5,350,417 | 9/1994 | Augustine | 607/104 |

*Primary Examiner*—John Kwon
*Attorney, Agent, or Firm*—Gray Cary Ware Freidenrich

[57] ABSTRACT

An air blower unit operates with reduced noise while providing a stream of warmed air. The blower unit includes a housing with an inlet at a first end and an outlet at a second end. A support positions the housing above a support surface such that the inlet points toward the support surface, and the outlet does not point away from the support surface. A rotatable blower creates an airstream by flowing air into the housing through the inlet and out of the housing through the outlet. The outlet is coupled to a delivery conduit having an elbow that absorbs some noise from the blower, and reflects remaining noise downward. The delivery conduit my be connected to a convective thermal blanket, for example. A motor, mechanically linked to the blower, rotates the blower and resides in the housing upstream of the blower. A heater, interposed between the blower and the motor, heats the fluid stream as it passes the heater.

26 Claims, 6 Drawing Sheets

LOW NOISE AIR BLOWER UNIT FOR INFLATING BLANKETS

BACKGROUND OF THE INVENTION

1. Field of the Invention

The present invention concerns a low-noise air blower unit that produces a stream of warmed air to inflate a thermal blanket.

2. Description of the Related Art

Augustine, et al. first described the use of temperature-controlled forced air to regulate the body temperature of patients, especially during and after surgery. U.S. Pat. No. 4,572,188, for example, used convective warming to prevent or treat hypothermia. In the '188 patent, temperature-controlled air is supplied by a blower unit that is connected to an airflow cover by a hose. In later-issued patents owned by the assignee of this application, the term "inflatable thermal blanket", synonymous with "airflow cover", is introduced. See, for example, U.S. Pat. No. 5,324,320, for "Thermal Blanket".

Inflatable thermal blankets assume a variety of shapes and sizes for specialized use, and include various inflatable structures that wrap around or drape over a patient. See, for example, U.S. Pat. Nos. 5,300,102 and 5,336,250. The mechanism fotr delivering heated air to a patient has also been expanded, beyond inflatable blankets, to include self-supporting tubes and plenums. See, for example, U.S. Pat. Nos. 5,300,101 and 5,350,417.

For ease of description, the various mechanisms for delivering a flow of temperature controlled air to bathe a patient are referred to herein as "thermal blankets." Patient-warming systems that use thermal blankets such as these may be collectively referred to as "convective warming systems." The basic convective warming system includes an air blower unit, a thermal blanket, and a flexible delivery hose connecting the two. These convective warming systems provide acknowledged clinical benefits. However, in certain situations, patients and medical personnel alike would benefit from having an air blower unit that operates as quietly as possible. Some patients, for example, may be sensitive to noise due to their particular medical conditions. Also, the operating room must be kept quiet to avoid distracting the operating team, and to aid the doctors and nurses in hearing vital sign monitors. Furthermore, quiet surroundings are desirable in post-operative recovery rooms to help patients gently emerge from anesthesia-induced sleep. Moreover, a reduced-noise air blower unit provides a competitive advantage in selling and marketing such units, whether for use in operating rooms, intensive care units, or a patient's hospital room.

FIGS. 1 and 2 illustrate the components of a typical air blower unit 100 (also "blower unit") in greater detail. The blower unit 100 includes a blower 102 powered by an electric motor 104. In many cases, the blower 102 comprises a squirrel cage blower. This type of blower typically has a short cylinder with a plurality of fan blades that are positioned around the circumference of the cylinder and oriented longitudinally. The blower 102 withdraws ambient air into all inlet 106 and creates an airstream that continues through an outlet 108. The outlet 108 is coupled to a tube 116 that connects to a thermal blanket 118 via a coupling ring 120. Filter media 110 may be provided proximate the inlet 106 to cleanse the ambient air. The stream of air created by the blower 102 is heated by a heater 112, which may comprise a resistive heating coil, receiving power from an electric power supply 114.

In operation, the blower unit 100 rests on the supporting surface 122, supported by feet or rollers 124. In this position, the blower 102 revolves about an axis of rotation 126. The blower 102 generates an airstream by drawing in air through the intake 106 in a direction 128 that is substantially parallel to the axis of rotation 126. The airstream flows through the intake 106 and is redirected by the blower 102 in a direction 130 that is substantially perpendicular to the axis of rotation 126. The airstream flows in the direction 130 out of the blower 102, through the heater 112 and out of the outlet 108 into the tube 116. In the prior art blower unit 100, the heater 112 is downstream of the blower 102, between the blower 102 and the outlet 108. The motor 104 is entirely out of the airstream, being neither upstream nor downstream of the blower 102.

Viewed differently, the vertical orientation of the axis of rotation 126 with respect to the air flow means that noise 132 will be emitted vertically upwardly, and noise 134 will be emitted parallel to the floor 122.

As mentioned above, known blower units would further benefit their users by operating with reduced noise. As an example, a significant amount of noise occurs as the airstream created by the blower 102 exits the unit 100 through the outlet 108. This airstream typically carries a measurable amount of noise generated by the motor 104 and the rotating blades of the blower 102. Since the airstream flows in the direction 130, so does the accompanying, noise 132. And, if the unit 100 rests upon the floor 122, the noise 132 will be projected upward 130 in the direction 130, toward the patient. Moreover, a significant portion of the noise 132 may be carried via the tube 116 directly into the blanket 118, as shown by the noise 136.

Another significant source of noise is found at the inlet 106 of the blower 102. In particular, some noise from the blower 102 and motor 104 projects outward through the inlet 106, opposite to the direction 128. Depending upon the placement of the blower unit 100, this noise 134 may be projected directly at medical staff and patient.

One approach to reducing the noise of a convective warming system is found in U.S. patent application Ser. No. 08/383,880, filed Feb. 6, 1995, for "A Source of Inflating Medium With Active Noise Cancellation for an Inflatable Thermal Core Apparatus", which is assigned commonly with this application and incorporated herein by reference. Here noise reduction is achieved by positioning active cancellation elements in the blower hose. This approach, however, does not quiet the blower unit itself.

In view of these considerations, then, there is a manifest need for a blower unit that is compact and operates with reduced noise, while providing a regulated, thermally controlled airstream.

SUMMARY OF THE INVENTION

Broadly, the present invention concerns a low-noise air blower unit that produces a stream of warmed air for inflating a thermal blanket, while reducing noise caused by its own operation. The blower unit includes a housing with an inlet at a first end and an outlet at a second end. A support positions the housing above a support surface such that the inlet points toward the support surface, and the outlet does not point upward. The housing may be rested on a floor, for example, or hung above the floor, from a stand used to administer intravenous fluids.

A rotatable blower, such as a squirrel cage fan in the housing, creates an airstream by flowing ambient air into the housing through the inlet and out of the housing through the outlet. The outlet is coupled to a delivery conduit having an elbow that absorbs noise from the blower, and reflects other noise downward. The delivery conduit may be connected to a convective thermal blanket, for example.

The blower rotates under power supplied by a motor, mechanically linked to the blower. The motor, residing in the housing, is placed in the airstream upstream of the blower. A heater, interposed between the blower and the motor, heats the airstream as it passes the heater.

The present invention provides its users with a number of distinct advantages. For example, the motor's presence in the airstream helps warm the air, thereby reducing the heater's workload. Also, unlike prior arrangements, the heater heats the air prior to passing through the blower, thereby efficiently mixing the heated air and avoiding any "channeling."

The invention provides another advantage by directing its outgoing airstream horizontally with respect to the support surface, rather than vertically, reducing noise sensed by those around the warming unit. This is possible since the blower is mounted on an axis of rotation that is substantially vertical with respect to the support support surface. Along these lines, the outgoing, airstream's noise is further reduced by the delivery conduit's elbow, which absorbs some noise waves and reflects other noise waves downward.

Further, the large filter media ensures reduction of a significant portion of blower noise that would otherwise pass through the inlet. Also, through the unit's positioning, noise that passes through the filter media and the inlet is directed downward toward the support surface, away from people nearby the unit.

BRIEF DESCRIPTION OF THE DRAWINGS

The nature, objects, and advantages of the invention will become more apparent to those skilled in the art after considering the following detailed description in connection with the accompanying drawings in which like reference numerals designate like parts throughout, wherein.

DETAILED DESCRIPTION OF THE PREFERRED EMBODIMENTS

Figure 1:
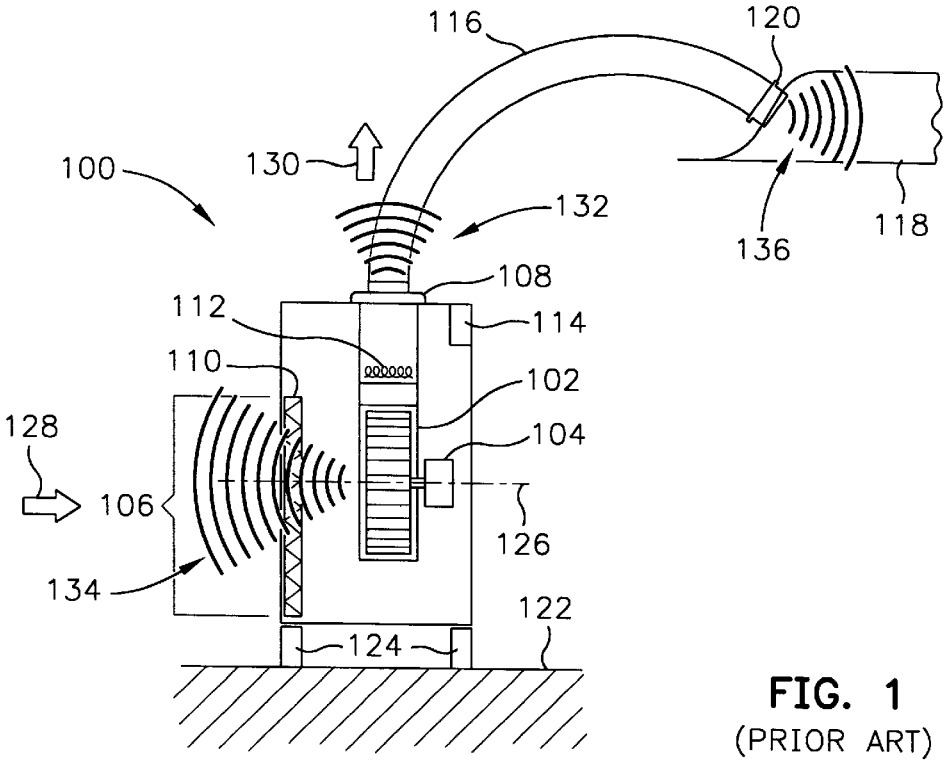
FIG. 1 (PRIOR ART)
FIG. 1 is a partially cut-away view at a first side of a known blower unit.
Figure 2:
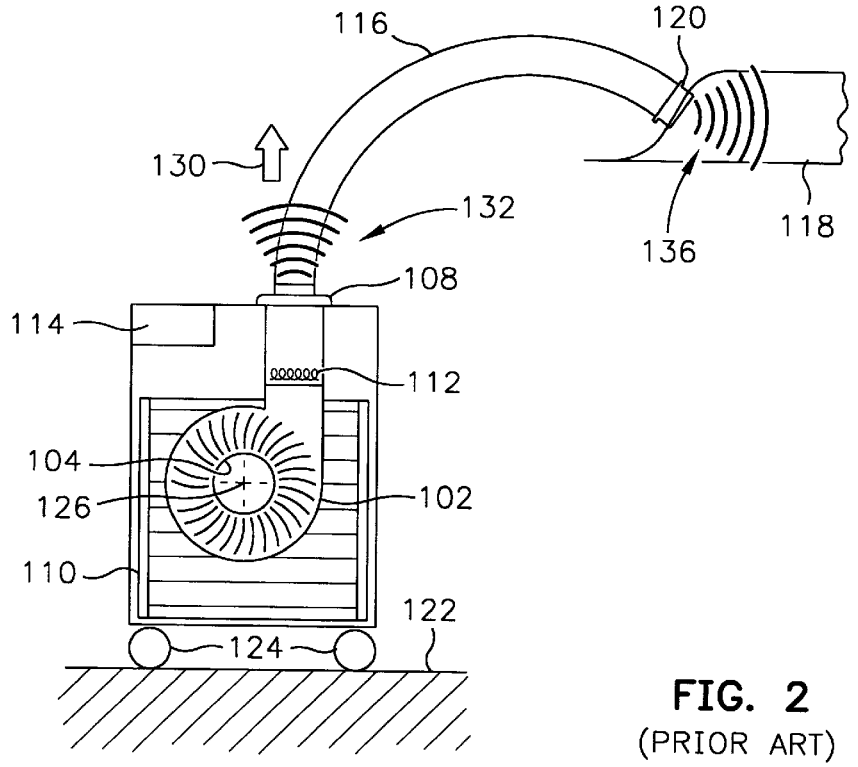
FIG. 2 (PRIOR ART)
FIG. 2 is a partially cut-away view at a second side of the blower unit of FIG. 1.

The inventor of the present application has observed that most of the sound generated by known blower units, such as the unit 100, is found in the noise 132. This noise 132 is primarily generated by the high-speed tips of the blower blades and turbulent airflow through the blower, ductings and heater. As shown in FIG. 1, the noise T32 exits the blower unit 100 straight into the tube 116 and then straight through the tube 116 toward a patient or caregiver. A secondary source of noise is the inlet 106. With the squirrel-cage type blower, the inlet noise 134 projects perpendicularly from the plane of the blower wheel.

Figure 3:
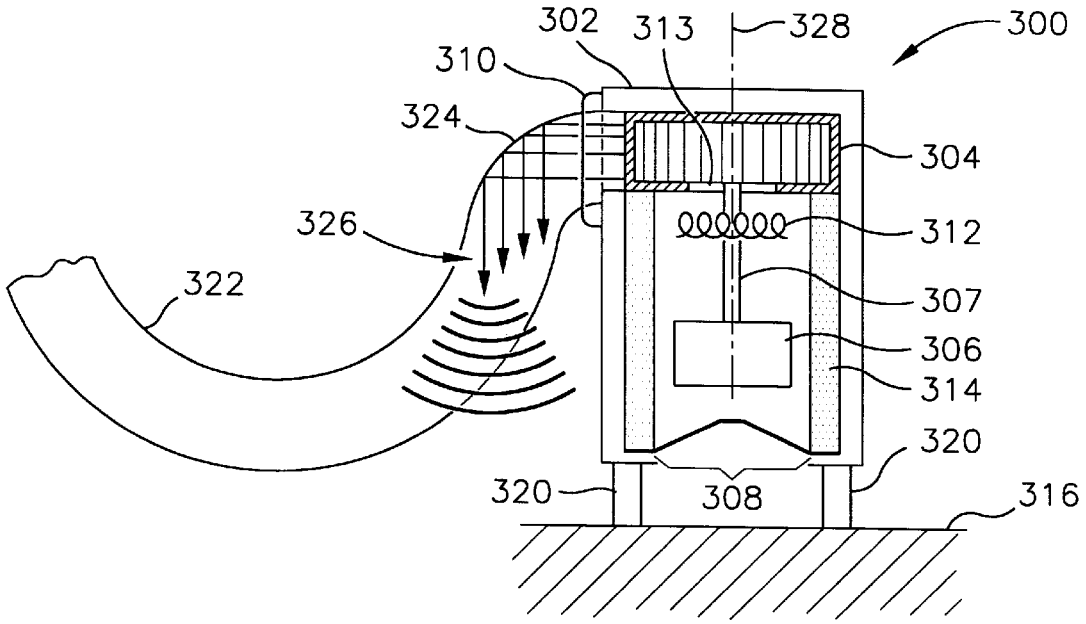
FIG. 3 is a partially cut-away side cross-sectional view of a warming unit pursuant to the invention.
Figure 4:
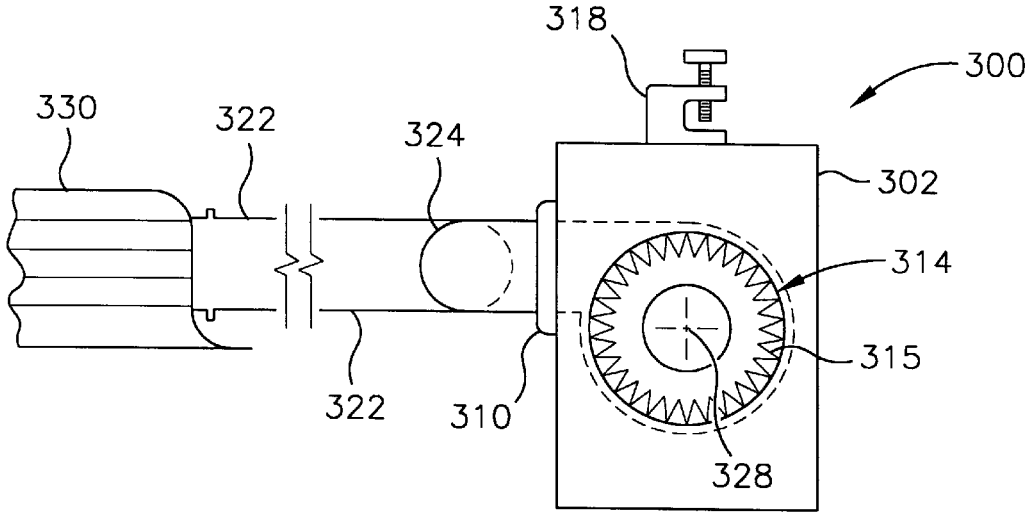
FIG. 4 is a is plan view of the warming unit of FIG. 3.
Figure 5:
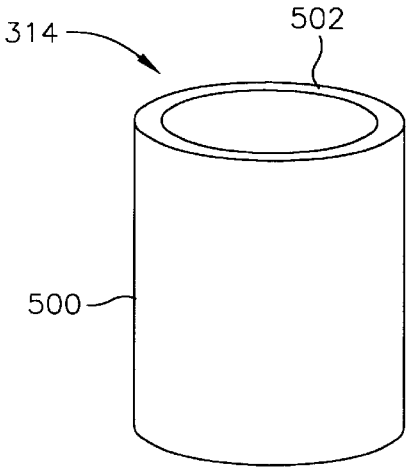
FIG. 5 is a top perspective view of a filter media of the invention.
Figure 6:
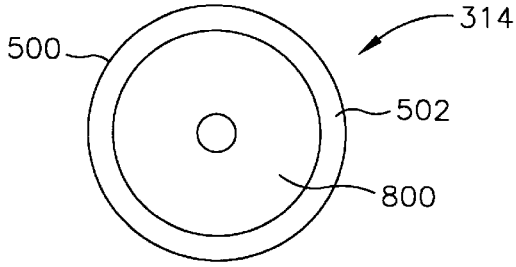
FIG. 6 is a plan view of the filter media of the invention.

Having recognized the above-mentioned and other characteristics of known blower units, and after considering the desirable attributes for a new blower unit, the inventor has developed a low-noise air blower unit. FIGS. 3–4 illustrate the principal components of a blower unit 300 in accordance with the invention. The blower unit 300 includes a cabinet 302 containing a blower 304 driven by an electric motor 306. Preferably the cabinet 302 may assume different configurations such as a compact, box-like shape. The blower 304 includes a plurality of fan blades, preferably arranged in a squirrel-cage configuration. The motor 306 preferably comprises an electric motor coupled to the blower 304 by a drive shaft 307. The blower 304 creates a stream of air ("airstream") by drawing ambient air through an inlet 308 and expelling the air through an outlet 310. The direction of the airstream is therefore from the inlet 308 toward the outlet 310. In the airstream, movement or location in the direction of tile outlet 310 is therefore "downstream", while movement or location toward the inlet 308 is "upstream".

In the illustrated embodiment, the motor 306 is positioned upstream from the blower 304. Placing the motor 306 in the airstream upstream of the heater 312 cools the motor 306 during, operation, significantly extending its life span. Moreover, waste heat from the motor 306 is discharged into the airstream and out of the cabinet helping to increase the temperature of the airstream. If the motor is not in the airstream, waste heat from the motor can accumulate in the cabinet, affecting any electronic components housed in the cabinet. Placing the motor 306 in the airstream also reduces the heater wattage necessary to produce a given airstream temperature.

Also positioned upstream from the blower 304 is a heater 312. The heater 312 preferably comprises a resistive heating element, which may be provided with a selected level of current to adjustably dissipate heat into the airstream created by the blower 304. Passing, air through a heater with a conduit usually results in "channeling" and uneven heating of the air. In the present design, air is heated as it enters the blower 304 which thoroughly mixes the air, providing a uniform temperature as the airstream leaves the blower 304. This occurs because the air is blown through the blower 304 after it is heated.

As recognized by the present inventor, much of the noise present at the inlet 308 emanates from the spinning blower 304. Therefore, placement of components such as the heater 312 and the motor 306 between the inlet 308 and the blower 304 acts to reduce inlet noise by blocking noise that the blower 304 would otherwise direct out the inlet 308.

FIG. 4 shows the low noise air blower unit of the invention coupled by air hose 322 to inflate a thermal blanket 330.

Filter

Figure 7:
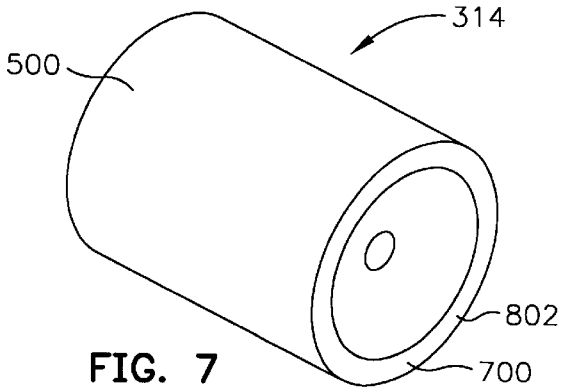
FIG. 7 is a bottom perspective view of the filter media of the invention.
Figure 8:
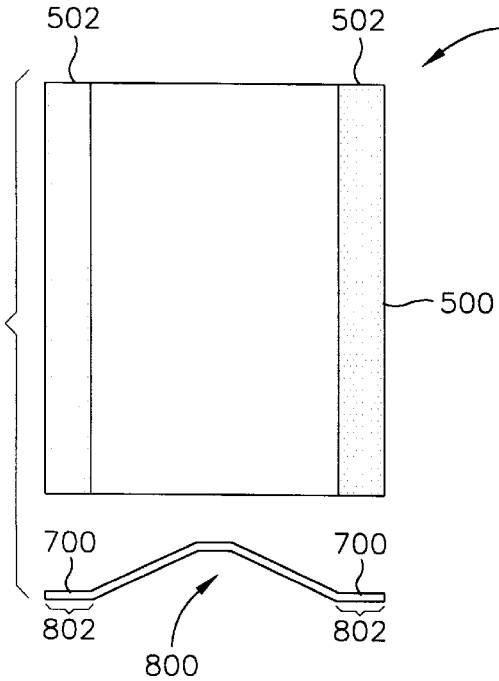
FIG. 8 is am exploded cross-sectional side view of the filter media of the invention taken along the line 6—6.

An important noise-reducing feature of the warming unit 300 is the filter 314 constructed from sound-absorbent material. The filter 314 reflects and absorbs a significant portion of the downward-traveling noise produced by the blower 304, thereby reducing the noise emanation from the inlet 308. FIGS. 5–9 illustrate the construction and operation of the filter 314 in greater detail. The filter 314 includes a noise-absorbent, hollow shaft 500 defining an upper lip 502 that encloses a blower intake aperture 313. Since the intake aperture 313 faces the inlet 308 of the housing 302, the filter 314 forms a continuous sound absorbing conduit that encloses the airstream between the inlet 308 and blower 304. The filter also includes a lower lip 700 (FIG. 7). The hollow shaft 500 preferably comprises rigid or semi-rigid fibrous substance or another sufficiently noise-absorbing material. High efficiency filters must have a large surface area or they will induce a very high resistance to airflow. Effective convective warming requires an airflow of at least 30 cubic feet per minute, for example. To accommodate this large airflow, the filter 314 preferably includes a plurality of pleats 315 to maximize the surface area of the filter material housed within the cabinet 302. Further, to maximize the compact design, the motor and heater are placed within the tubular filter to use this otherwise wasted space. The filter 314 additionally includes a noise-absorbent convex base 800, as clearly shown in FIG. 8. The base 800 includes an outer edge 802 connected to the lower lip 700. The base 800 preferably comprises a molded plastic cap, sealing the end of the hollow shaft 500. The base 800 defines a convex shape, which may be embodied in a conical, convex, or another suitable shape. Preferably, the base 800 is slightly conical in shape and may be molded from or covered with a sound-absorbing material. Sound waves that pass the motor are either absorbed by the cap material or reflected laterally by the conical surface, to be absorbed by the pleats of the hollow shaft 500.

Figure 9:
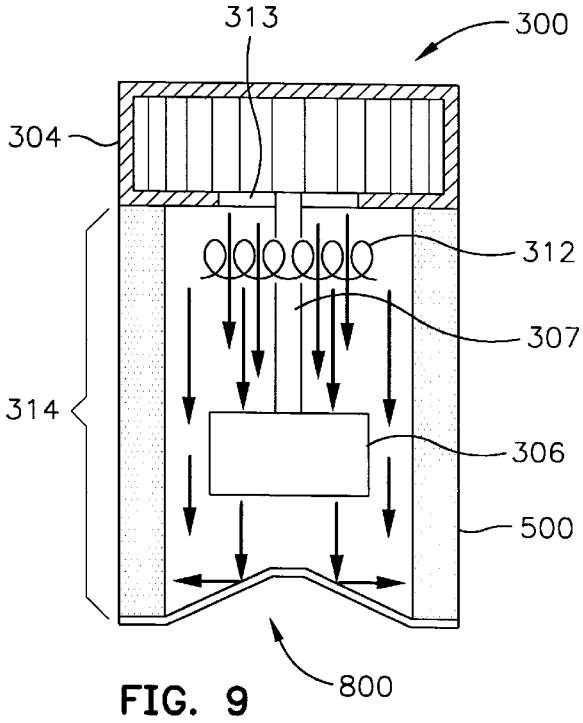
FIG. 9 is a cross-sectional side view illustrating the filter media in relation to other components of the blower unit, illustrating the noise-reduction function of the filter media.

More particularly, as shown in FIG. 9, the shape of the convex base 800 functions to receive sound waves from the blower 304 and reflect the sound waves outward to the noise-absorbent material of the hollow shaft 500. In this respect, the material of the convex base 800 preferably comprises a material that is reflective to the frequency of noise generated by the blower 304, which material may also be absorbent of the sound waves to a desired degree. Moreover, to further reduce noise in the cabinet 302, sound mufflers or baffles may be placed inside the cabinet 302 within the filter 314.

Positioning

Referring to FIGS. 3 and 4, another noise-reducing feature of the warming unit 300 is its positioning, during use. Particularly, the warming unit 300 includes a support to position the unit 300 during operation such that the inlet 308 is generally pointed toward the floor 316. The support may comprise a floor support 320 such as feet, rollers, legs, or another device to Support the unit 300 upon a horizontal support surface. Alternatively, the support may comprise a clamping support 348 to hang the unit 300 from a piece of equipment such as an IV drug stand. By supporting the warming unit 300 in this way, noise from the blower 304 that passes through the filter 314 and the inlet 308 is directed downward toward the floor 316 away from the patient and others present in the room.

Side Projection

Referring to FIGS. 3 and 4, another noise-reducing feature of the warming unit 300 is the orientation of the outlet 310. Unlike prior arrangements such as the blower unit 100, the outlet 310 is provided on a side of the cabinet 302 rather than the top. Therefore, when the outlet 310 is coupled to air hose 322, noise from the blower 304 that enters the conduit 322 travels outward (FIG. 3) rather than upward (FIG. 1). This placement of the outlet is possible because the blower 304 rotates upon a substantially vertical axis 328. As a result, the plane of rotation of the blower 304 is horizontal, creating an airstream that flows laterally through the outlet 310.

Sound and noise consist of pressure waves of different frequencies and amplitudes traveling through a medium, usually air. Like waves on a still pond, these waves are subject to destructive interference and cancellation. Sound waves, which follow substantially straight paths, when directed around a bend or along a serpentine path reflect off the walls of the pathway and lose energy. In the preferred embodiment, the hose 322 includes such a contour in the form of an elbow 324 that defines a rigid or semi-rigid bend in the hose 322 of between about 45 degrees and 90 degrees. The elbow 324 preferably comprises a soft, pliable rubber or plastic material that is sound-absorbing. So constructed, the elbow 324 absorbs a significant amount of noise outwardly projected by the blower 304. The noise waves that are not absorbed by the elbow 324 are downwardly reflected by the elbow 324, as shown by the arrows 326. Therefore, these noise waves are directed toward the floor 316, minimizing the impact of this noise upon the patient and others in the room. The conduit may further include a noise attenuator in the form of a baffle placed inside the conduit. Preferably, the outlet 310 includes a swivel collar (shown in FIG. 10 in more detail) permitting the elbow 324 to rotate in respect to the outlet 310. This reduces the stress on the hose 322 as it is stretched into different positions, yet allows the conduit 322 to hang neatly by the side of the warming unit 300 when not in use.

Swivel Collar

Figure 10:
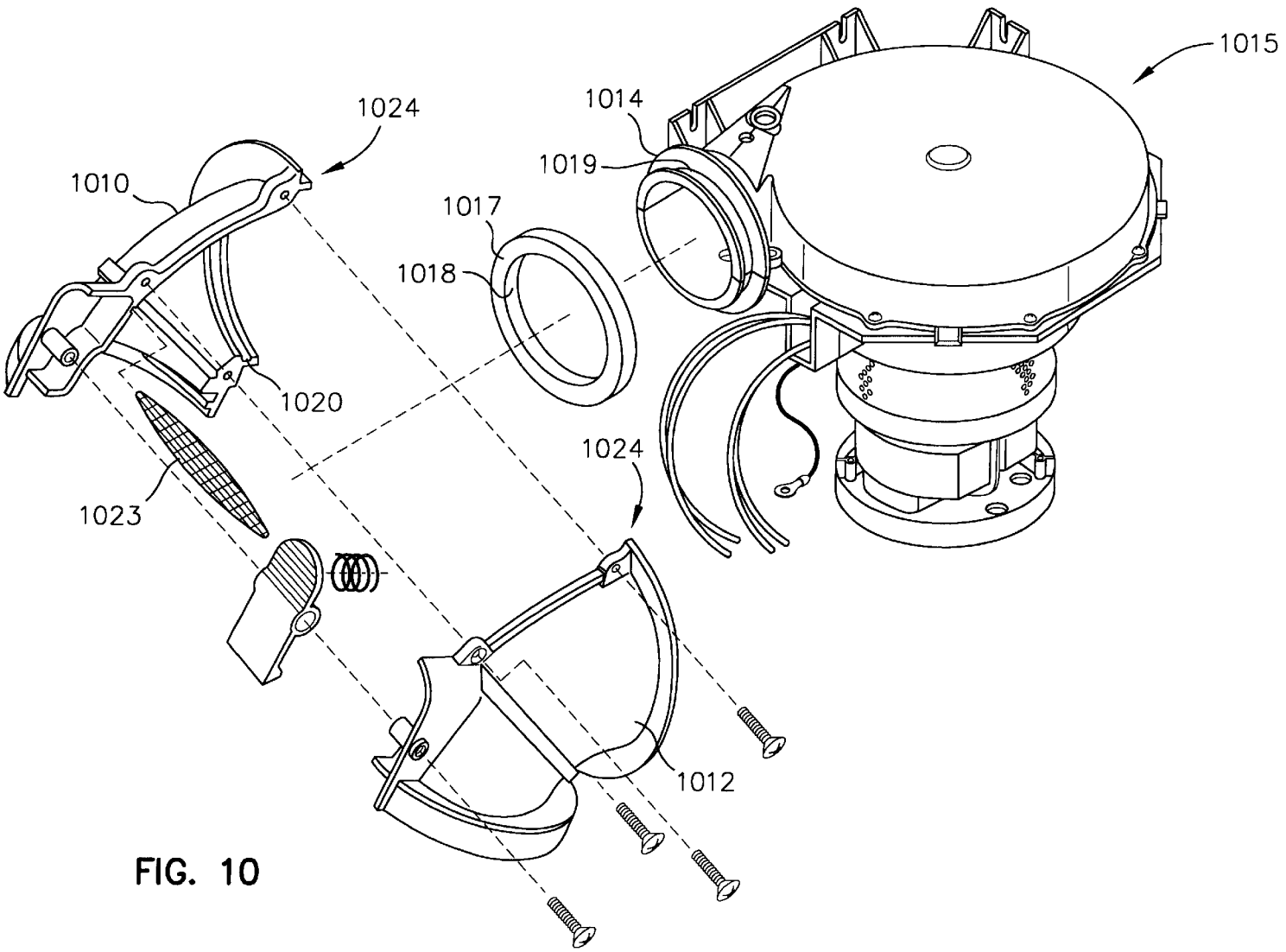
FIG. 10 is an assembly drawing showing a swivel collar in an elbow of the blower unit of the invention.

FIG. 10 shows, in more detail, an elbow 1024 which conforms to the description and function of the elbow 324. In FIG. 10, the elbow 1024 is assembled from two opposing pieces 1010 and 1012 that, when assembled, form a flange that faces a corresponding flange 1014 on a blower/heater/motor unit 1015 constructed in accordance with the description of the blower unit shown in FIGS. 3 and 4. The elbow 1024 is swivelly coupled to the flange 1014 by a swivelling collar 1017 that is retained, on its inner annular surface 1018 in a collar race 1019 on the flange 1014. The flange formed by the pieces 1010 and 1012 includes a race for engaging the outer annular surface 1019 of the swivelling collar 1017. A portion of this race is indicated on the piece 1010 by reference numeral 1020. The noise attenuator comprises a baffle 1023 held between the pieces 1010 and 1012.

Blower/Heater/Motor Assembly

Figure 11:
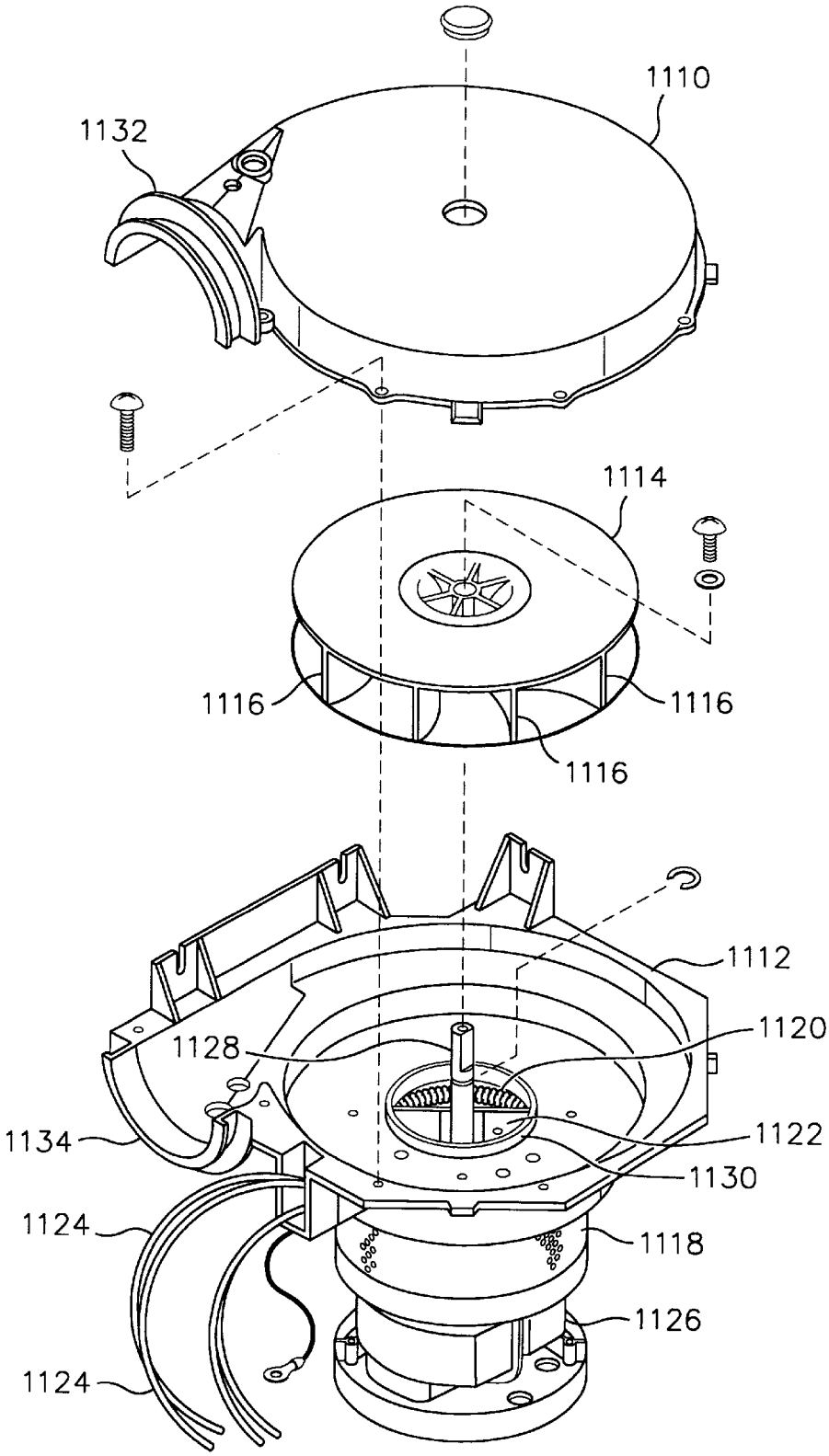
FIG. 11 is an exploded view of showing how the motor, heater, and blower of the invention are assembled.

FIG. 11 shows, in an exploded view, how a blower heater, and motor are assembled according to the best mode of the invention. In FIG. 11, a blower includes upper and lower enclosure pieces 1110 and 1112, respectively. The pieces 1110 and 1112 are assembled to enclose a disc-shaped rotor 1114 having curved blades 1116. The disc-shaped blower is substantially horizontally disposed in the preferred operating environment, as explained above in respect of FIGS. 3 and 4. Preferably, the disc-shaped rotor 1114 is a molded plastic piece. An annular enclosure 1118 is mounted on the underside of the lower enclosure piece 1112. A heating coil 1120 is contained in the enclosure 1118 underneath (upstream of) the blower. The heating coil 1120 is conventionally mounted on a frame 1122 in the enclosure 1118 and is activated by conduction of electricity through a pair of wires 1124. A motor 1126 is mounted to the enclosure 1111 beneath (upstream of) the heating coil 1120. The motor 1126 includes a drive shaft 1128 that protrudes upwardly through a circular hole 1130 in the lower enclosure piece 1112. The drive shaft 1128 receives and rotates the disc-shaped rotor 1114. Air stream flow in the blower/heater/motor assembly of FIG. 11 is upward past the motor 1126 and heater coil 1120 through the circular hole 1130, into the blower, where the rotor 1114 deflects the air stream sideways through the outlet in a flange formed by pieces 1132 and 1134.

IV Pole Mounting

Figure 12:
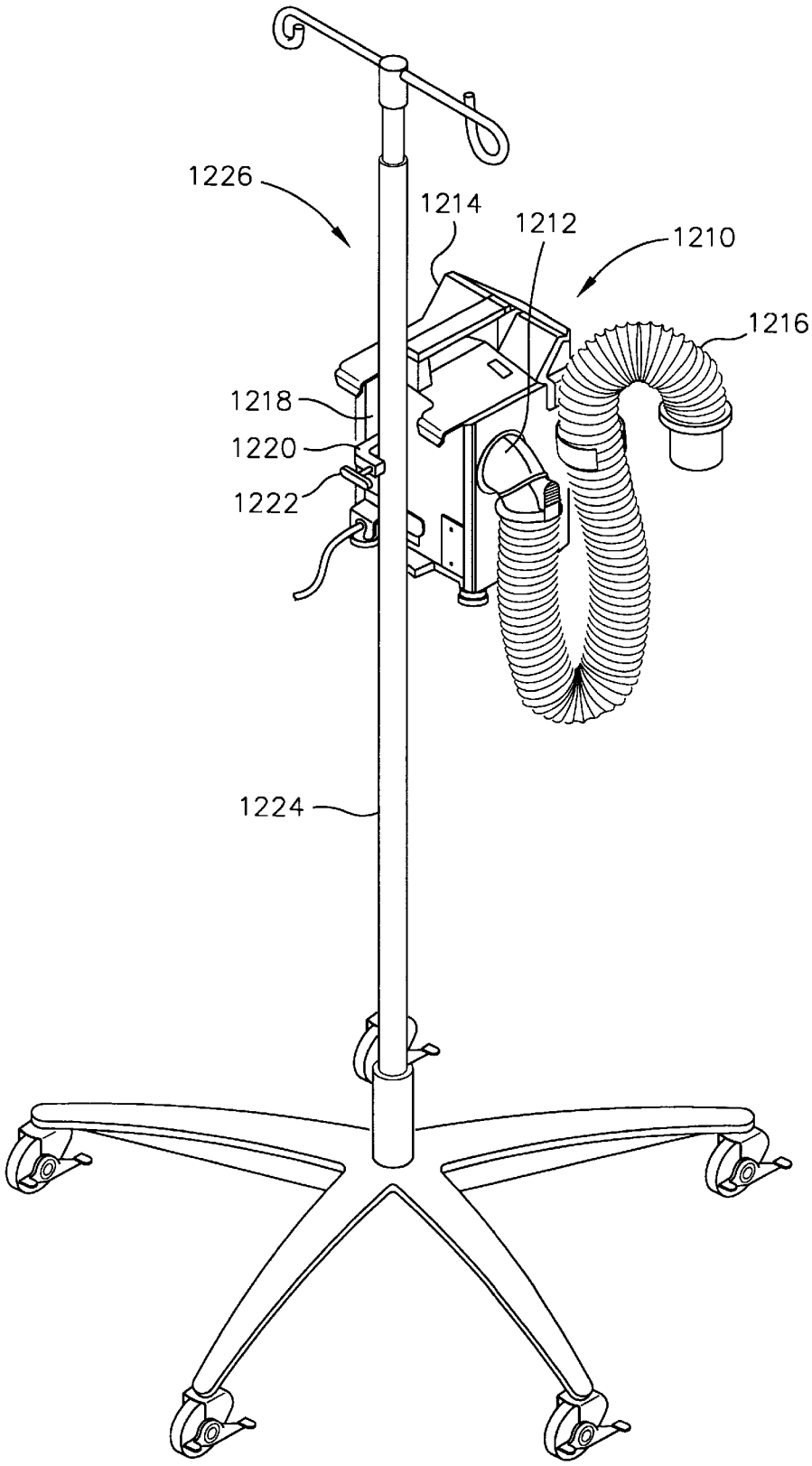
FIG. 12 is an illustration of how the blower unit may be mounted on an IV stand.

FIG. 12 shows a low noise air blower unit for inflating a thermal blanket in an embodiment adapted for mounting on an IV (intravenous) pole. Here, the blower unit 1210 is constructed according to the principles set forth in connection with FIGS. 3–11 for reduction of noise. The blower unit 1210 includes an elbow 1212 mounted to swivel on an enclosure 1214. An air hose 1216 is mounted to the elbow 1212 for delivery of a warned air stream to an inflatable thermal blanket (not shown). The blower unit 1210 includes, mounted to a back surface 1218 of the enclosure 1214, a C-shaped attachment clamp 1220 with a threaded clamping screw 1222 that engages the vertical pole 1224 of a conventional IV pole assembly 1226.

OTHER EMBODIMENTS

While there have ben shown what are presently considered to be preferred embodiments of the invention, it will be apparent to those skilled in the art that various changes and modifications can be made herein without departing from the scope of the invention as defined by the appended claims.

I claim:

1. A blower unit for a convective warming system, comprising:

a housing with two ends, the housing having an inlet at a first end and an outlet at a second end;

a support to position the housing over a support surface;

a rotatable blower in the housing for flowing an airstream into the housing through the inlet and horizontally out of the housing through the outlet;

a motor, mechanically coupled to the blower to rotate the blower;

a heater element to heat the airstream;

a delivery conduit coupled to the outlet; and an elbow in the delivery conduit proximate the outlet.

2. The blower unit of claim 1, wherein the blower has a substantially disk structure that is disposed in the blower unit to be substantially horizontal with respect to the support surface.

3. The blower unit of claim 1, wherein the motor is positioned in the housing upstream of the blower.

4. The blower unit of claim 3, wherein the heater element is located in the housing between the blower and the motor.

5. The blower unit of claim 1, further comprising an inlet filter comprising:

a noise absorbent hollow shalt defining an upper lip, a lower lip, and a base connected to the lower lip, wherein said shaft encircles the motor and heater elements and said upper lip is positioned proximate the blower.

6. The blower unit of claim 5, wherein the base is a noise absorbent convex base protruding inward of the filter toward the upper lip and defining an outer edge connected to the lower lip.

7. The blower unit of claim 6, wherein the hollow shaft is substantially cylindrically shaped.

8. The blower unit of claim 6, wherein the convex base is substantially cone shaped.

9. The blower unit of claim 6, wherein the hollow shaft comprises at least one fibrous layer.

10. The blower unit of claim 6, wherein the convex base comprises at least one fibrous layer.

11. The blower unit of claim 1, wherein the heater element comprises a metallic conductor.

12. The blower unit of claim 1, wherein the elbow comprises a bend in the delivery conduit of at least 45 degrees.

13. The blower unit of claim 1, wherein the inlet resides in a first plane and the outlet residing, in a second plane substantially perpendicular to the first plane.

14. The blower unit of claim 1, further comprising a noise attenuator placed inside the delivery conduit.

15. The blower unit of claim 14, wherein the noise attenuator comprises a baffle.

16. The blower unit of claim 1, further comprising an element in the conduit to reflect noise.

17. The blower unit of claim 1, further comprising a noise-absorbent material in the conduit.

18. An air blower for inflating a thermal blanket, comprising:

a housing with two ends having an inlet at a first end and an outlet at a second end;

a rotatable blower to create an airstream by flowing air into the housing through the inlet and out of the housing through the outlet;

a motor, mechanically linked to the blower and placed in the housing upstream of the blower, to rotate the blower; and, a heater element to heat the airstream, the heater element being located between the blower and the motor.

19. An air blower for inflating a thermal blanket, comprising:

a housing with two ends, the housing having an inlet at a first end and an outlet at a second end;

a support to position the housing over a support surface such that the inlet is substantially oriented toward the support surface;

a rotatable blower in the housing positioned between the inlet and the outlet to create an airstream by flowing air into the housing through the inlet and out of the housing through the outlet;

a motor in the housing, coupled to rotate to the blower; and a heater element in the housing to heat the airstream.

20. An air blower for inflating a thermal blanket, comprising:

housing with two ends, the housing having an inlet at a first end and an outlet at a second end;

a support to position the housing over a support surface such that the outlet is oriented to direct an airstream substantially horizontally with respect to the support surface;

a rotatable blower in the housing to create the airstream by flowing air into the housing through the inlet and out of the housing through the outlet;

a motor in the housing, coupled to rotate the blower; and a heater element in the housing to heat the airstream.

21. An air blower for inflating a thermal blanket, comprising:

a housing with two ends, the housing having an inlet at a first end and an outlet at a second end;

a rotatable blower in the housing to create an airstream by flowing air into the housing through the inlet and out of the housing through the outlet, said blower having an intake aperture facing the inlet;

a motor in the housing coupled to the blower to rotate the blower;

a heater element in the housing to heat the airstream; and an inlet filter in the housing comprising:

a noise absorbent hollow shaft of filter material having an upper lip and a lower lip, wherein said upper lip substantially encloses the intake aperture, and a convex base protruding inward of the filter toward the upper lip and defining an outer edge connected to the lower lip.

22. The air blower of claim 21, wherein the base has a convex shape and protrudes inwardly of the filter toward the upper lip to define an outer edge connected to the lower lip.

23. The air blower of claim 21, wherein the hollow shaft is substantially cylindrically shaped.

24. The air blower of claim 21, wherein the base is substantially convex shaped.

25. The air blower of claim 21, wherein the base comprises a noise absorbent material.

26. The air blower of claim 21, wherein the base comprises a noise reflective material.

* * * * *